United States Patent [19]

Jackson, III

[11] 4,120,152

[45] Oct. 17, 1978

[54] ANTI-VORTEX PINTLE

[75] Inventor: Eugene D. Jackson, III, Canoga Park, Calif.

[73] Assignee: Rockwell International Corporation, El Segundo, Calif.

[21] Appl. No.: 777,732

[22] Filed: Mar. 15, 1977

[51] Int. Cl.[2] ..... B63H 11/00

[52] U.S. Cl. ..... 60/221; 115/16; 415/209; 415/72; 415/215

[58] Field of Search ..... 415/72–75, 415/167, 209, 202, 215; 60/221, 222; 115/11, 14, 16, 42; 239/256.11, 256.19

[56] References Cited

U.S. PATENT DOCUMENTS

| | | | |
|---|---|---|---|
| 3,030,909 | 4/1962 | Barnes et al. | 415/215 |
| 3,306,046 | 2/1967 | Trapp | 115/14 |
| 3,328,961 | 7/1967 | Aschauer | 115/16 |
| 3,405,526 | 10/1968 | Aschauer | 115/16 |
| 3,849,982 | 11/1974 | Hall | 415/209 |
| 3,951,565 | 4/1976 | Rothe et al. | 415/215 |
| 3,977,353 | 8/1976 | Toyama | 115/16 |

FOREIGN PATENT DOCUMENTS

| | | | |
|---|---|---|---|
| 23,360 of | 1912 | United Kingdom | 45/209 |

*Primary Examiner*—C. J. Husar

*Attorney, Agent, or Firm*—L. Lee Humphries; Robert M. Sperry

[57] ABSTRACT

In high velocity pumps such as waterjet pumps, flow leaving the rotor is guided to a smaller discharge diameter by a stator-nozzle combination. To achieve maximum thrust efficiency, the whirl component of velocity must be eliminated at the nozzle exit. Two or more low profile, substantially straight guide vanes are added to the pintle body to destroy any potential whirl component of velocity leaving the stator before being discharged in the exiting stream of water.

1 Claim, 4 Drawing Figures

ANTI-VORTEX PINTLE

BACKGROUND OF THE INVENTION

1. Field of the Invention

This invention is related to axial flow pumps.

More particularly, this invention is related to axial flow waterjet pumps that discharge a solid jet of water to affect waterjet steering and reversing.

2. Description of the Prior Art

State-of-the-art waterjet pumps normally require a small diameter, solid jet of water at the pump discharge to affect steering and reversing capability and to minimize the jet diameter to avoid the boat structure. For example, axial flow pumps accelerate water through inducer/stator combinations that discharge through a necked-down housing. The complexity of the three-dimensional flows entering and passing through the stator/nozzle combination is enormous, and exact calculations of the three-dimensional velocity field to completely eliminate the resultant whirl over a range of operating conditions is beyond the current state-of-the-art. Even if the residual whirl at the stator discharge is minimal, this velocity will significantly increase as the flow is forced to smaller radii at the nozzle discharge. Whirl velocity upstream of the pump discharge nozzle destroys thrust efficiency, stability and maximum thrust of a waterjet pump. Heretofore, empirical approaches at defining the whirl problem have also been inadequate due to the complexity of the flow field and the severe environment imposed on the instrumentation.

While numerous waterjet pump patents of the type just described are in existence, none of these concepts recognize or solve the problem of tangential whirl pump efficiency losses.

Accordingly, the present invention substantially eliminates the tangential whirl that results from the fluid stream exiting the stator vanes in the housing, down the diverging pintle center body and out the discharge nozzle.

SUMMARY OF THE INVENTION

An improvement to a high velocity axial flow pump is disclosed wherein flow leaving an inducer or axial rotor is guided through a large diameter annulus formed by an outer housing and a center pintle body to a smaller nozzle discharge diameter by a stator, pintle, combination. At least one substantially axially-aligned, radially-extended guide vane is affixed to the pintle, a first end of the guide vane is affixed to the pintle near the downstream exit of the stator, a second end of the guide vane is affixed to and terminates substantially at the discharge end of the pintle body adjacent the nozzle, the guide vane serving to substantially eliminate tangential whirl of fluid prior to the fluid exiting the nozzle.

Two or more guide vanes are added to a pintle to destroy any potential whirl component of velocity existing at the stator exit. The vanes must be on the pintle rather than the nozzle housing due to the free-vortex action along the pintle being much more detrimental to performance. This is true because of the smaller radius and higher whirl velocities created as the fluid is directed through the large diameter annulus formed by the pump housing and the pintle, and accelerated down the pintle face as it exits the trailing edge of the stators towards the smaller diameter nozzle opening. Two relatively straight vanes are sufficient to eliminate the whirl, assuming a reasonable stator vane design. More vanes would add friction loss and contribute to nozzle blockage. The vanes need not extend over the whole passage height to be effective and should be of sufficient thickness to withstand the structural loads.

It is an object of this invention to substantially eliminate the tangential whirl component from axial flow pumps.

More specifically, it is an object of this invention to eliminate the tangential whirl component from axial flow waterjet pumps that discharge fluid in a solid stream through a relatively narrow opening downstream of a larger diameter pintle center body.

An advantage over the prior art relative to waterjet pumps is the increased efficiency of the pumps resulting in less power output for the same thrust performance thereby less fuel is utilized to drive the waterjet pumps.

Still another advantage over the prior art with respect to waterjet pumps is that better pump performance allows the engines driving the pump to be derated, since less power results in the same performance obtained without the anti-whirl device, hence a longer time between overhauls (TBO) is the benefit.

The above-noted objects and advantages of the present invention will be more fully understood upon a study of the following detailed description in conjunction with the detailed drawings.

DESCRIPTION OF THE PREFERRED EMBODIMENTS

Figure 1:
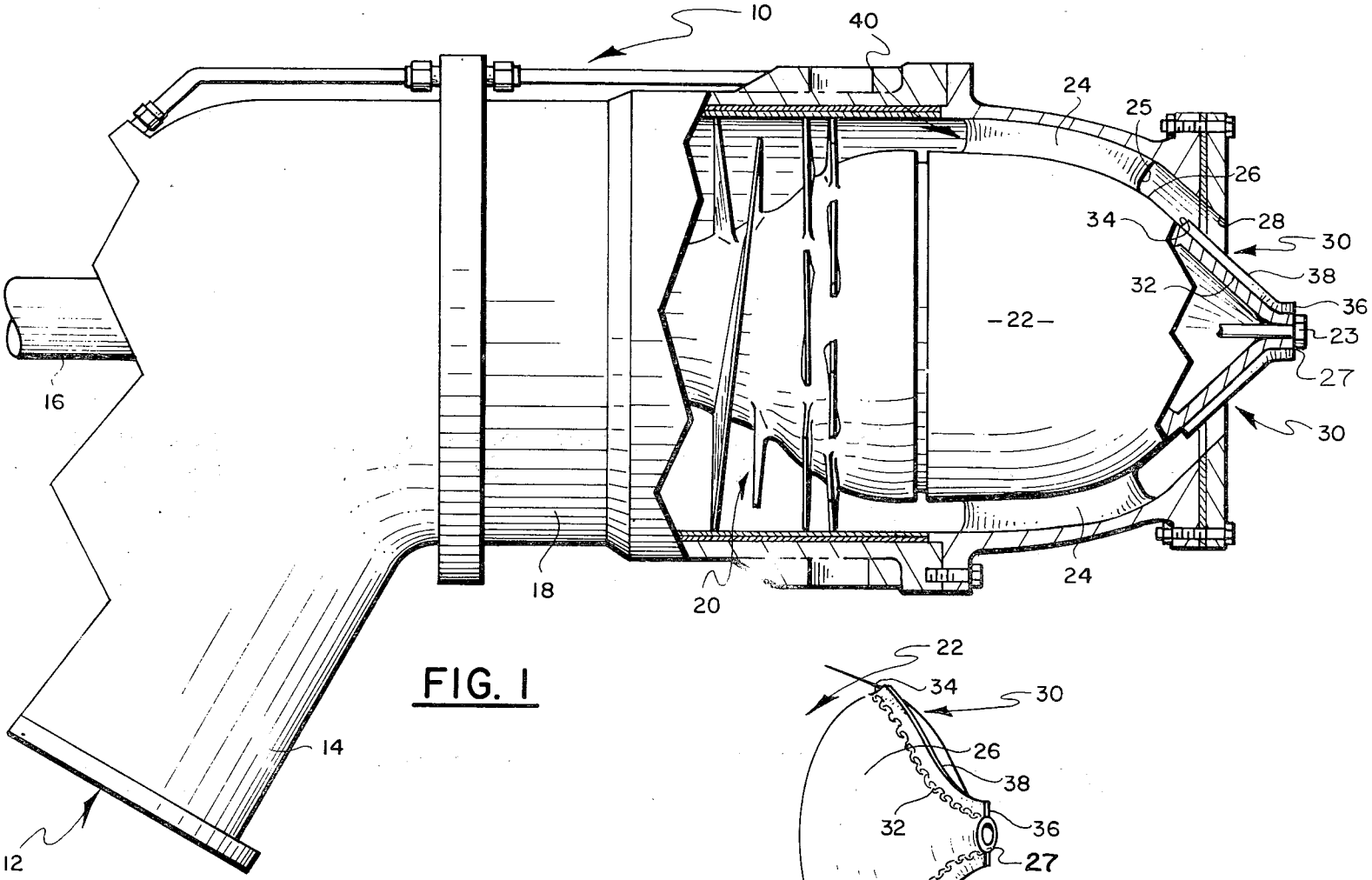
FIG. 1 is a partially, cutaway cross-sectional of the preferred embodiment of the invention.

Referring now to FIG. 1. The waterjet pump generally designated as 10 is comprised of an inlet 12 and an inlet housing 14 with a pump drive shaft 16 therethrough. The drive shaft 16 is connected to an inducer generally designated as 20. Downstream of the inducer is a center pintle body 22 which is concentric within pump housing 18. The pintle is typically held concentrically by a series of stator vanes 24. Annulus 40 is formed by the outer pump housing 18 and the outer surface 26 of the inner pintle body 22, the center pintle body terminating at end 27 adjacent nozzle opening 28 formed by the end of the pump housing 18. A retention bolt 23 retains the end 27 of the pintle to the center pintle body 22.

A pair of guide vanes generally designated as 30 are attached to the face 26 of the pintle 22. Preferably the base 32 of the guide vanes 30 are metallurgically bonded to the diverging face 26 of center pintle body 22. The guide vanes 30 are preferably low profile, i.e., the peripheral edge 38 of guide vanes 30 need not extend into annulus 40 more than one-half the distance of annulus. The end 34 of guide vanes 30 is positioned downstream of end 25 of the stator 24. The purpose of this will be explained later on in the specification. The opposite end 36 of guide vanes 30 terminates adjacent the discharge end 27 of center pintle body 22. The guide vanes are aligned essentially parallel with the axis of the center body 22. The low profile guide vanes may be fabricated from a compatible material such as titanium of sufficient thickness to withstand the force of the fluid passing down the diverging face 26 and out through the nozzle 28 of the pump.

Figure 2:
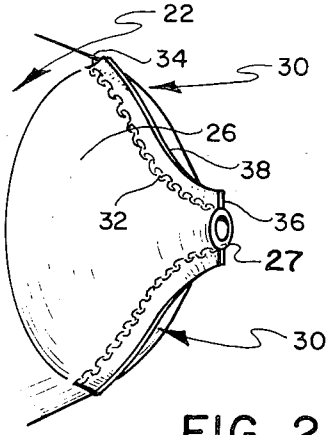
FIG. 2 is a perspective view of the pintle centerbody with the anti-vortex vanes attached thereto.

Turning now to FIG. 2. The guide vanes 30 are more clearly illustrated wherein the base 32 of the low profile vanes are welded to the face 26 of center pintle body 22.

In operation, for example, as the waterjet pump is spinning, fluid is accelerated by the inducer 20 into the annulus 40 where a multiplicity of stators 24 redirect the accelerated fluid out the nozzle 28. The purpose of the stators in the prior art is to efficiently arrest the centrifugal force imparted to the fluid by the inducer and direct the accelerated fluid in an axial direction so that the fluid exiting nozzle 28 passes out of the nozzle in a solid stream. Any tangential whirl detracts from the force of this solid stream of fluid exiting nozzle 28. Despite all efforts some tangential whirl is evident after the fluid passes by the exit 25 of each of the stator 24. This rotating fluid is accelerated down face 26 of center pintle body 22 by the diverging wall of the pump housing just upstream of the nozzle 28 and as this rotating fluid passes down this surface, it increases in velocity because of the conservation of angular momentum. The angular momentum of the fluid is proportional to the product of the whirl velocity and the radius relative to the pump centerline. As the fluid flows along the pintle surface, the radius is decreasing, and to conserve the angular momentum, the whirl velocity must increase until it becomes so large as to form a cavitation pocket. The addition of the anti-vortex vanes prevents the fluid from accelerating to significant large whirl velocities. Thus, a means is provided to stop this low efficiency phenomenon by interrupting the whirling motion by guide vanes 30. Guide vanes 30 stop this whirling motion and assure that the fluid passing out nozzle 28 does so in a solid stream of fluid. It has been determined through actual tests in existing waterjet pumps that there is a 2–3% increase in thrust and pump efficiency.

Figure 3:
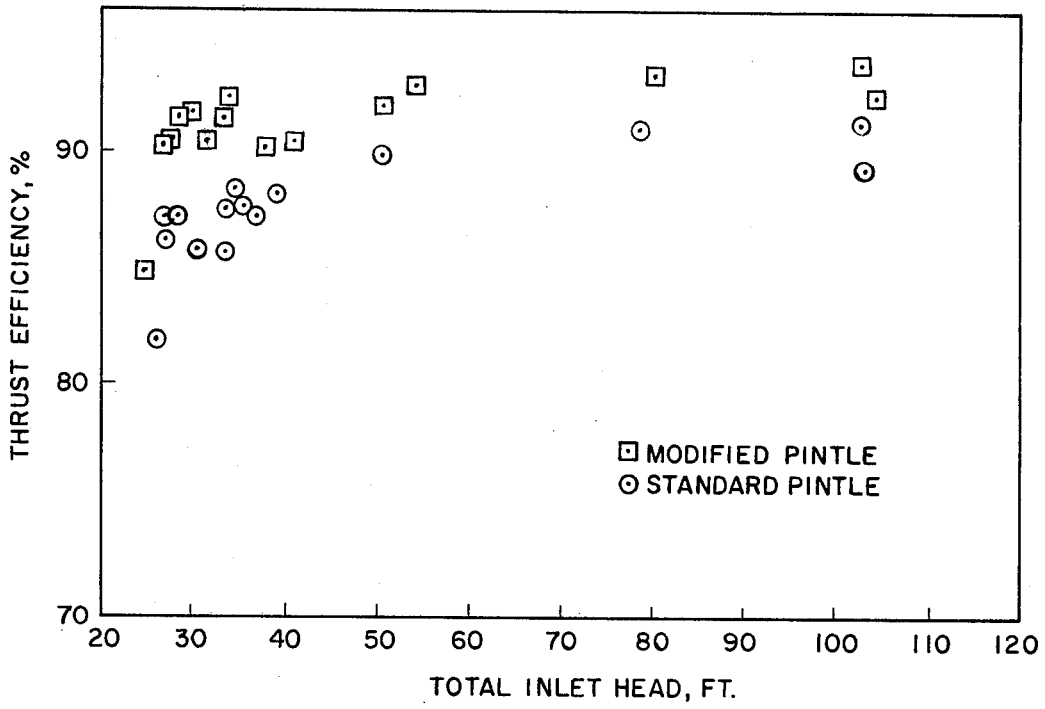
FIG. 3 is a chart illustrating the increase in thrust efficiency with the anti-vortex vanes in position versus the pump without the vanes; and, FIG. 4 is a chart illustrating the pump efficiency increase with the vanes in position versus the pump without the vanes.
Figure 4:
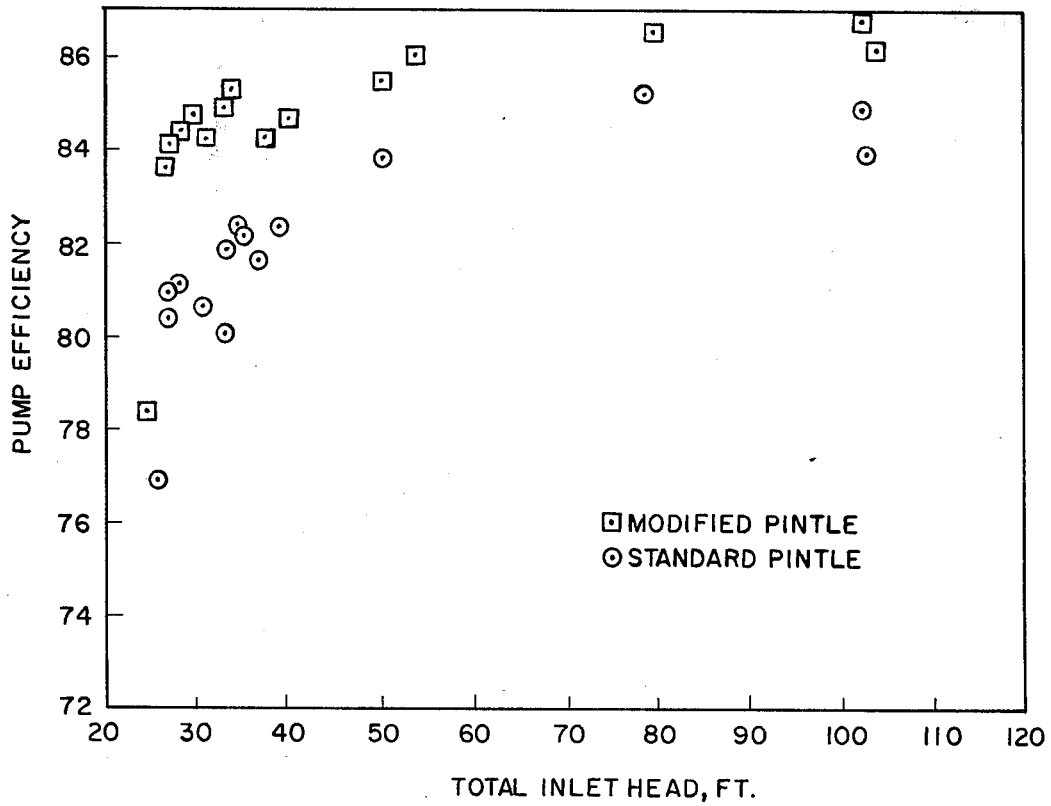

This increase in efficiency is illustrated in FIG. 3 wherein there is shown a 2–3% thrust efficiency increase in the squared data points, all of which are above the circled dot standard pintle data points clearly showing the improved thrust efficiency. FIG. 4 likewise illustrates the increased efficiency in the pump operation wherein the modified pintle with the vanes affixed thereto shows an increase in pump efficiency by the squared pattern, all of which are above the circled dot data point pattern illustrated on the chart showing a standard pintle without the vanes.

It would be obvious to have only one guide vane of the diverging face of the pintle, and it would be equally obvious to have more than a pair of guide vanes on the diverging face of the pintle. The guide vanes need to be on the pintle body rather than on the wall of the pump housing as heretofore described because the whirl phenomenon is more severe on the diverging face of the pintle because of its smaller radius and the resulting larger whirl velocities required to satisfy conservation of angular momentum.

It is additionally obvious that this improvement to an axial flow waterjet pump is applicable to any axial flow pump whether it be utilized in a waterjet craft or not. Additionally, it would be obvious to utilize fluids other than water.

It will, of course, the realized that various modifications can be made in the design and operation of the present invention without departing from the spirit thereof. Thus, while the principle, preferred instruction, and mode of operation of the invention have been explained and what is now considered to represent its best embodiment has been illustrated and described, it should be understood that within the scope of the appended claims the invention may be practiced otherwise than as specifically illustrated and described.

I claim:

1. A high velocity axial flow pump apparatus wherein flow leaving an inducer is guided through a large diameter annulus formed by an outer housing and a center pintle body to a smaller nozzle discharge diameter by a stator, pintle, nozzle combination, the improvement which comprises:

at least one substantially axially aligned, radially extended guide vane affixed to said pintle, a first end of said guide vane being affixed to said pintle near the downstream exit of said stator, a second end of said guide vane is affixed to and terminated substantially at the discharge end of said pintle body adjacent said nozzle, said guide vanes being low profile, said guide vanes protruding beyond the surface of said pintle in a radially outward direction towards said surrounding pump housing a distance one-half or less the annulus between said pintle and said housing a minimize frictional drag and nozzle blockage of the outflowing fluid, said guide vane serving to substantially eliminate tangential whirl of fluid prior to the fluid exiting said nozzle.

* * * * *

UNITED STATES PATENT AND TRADEMARK OFFICE

CERTIFICATE OF CORRECTION

PATENT NO. : 4,120,152

DATED : October 17, 1978

INVENTOR(S) : Eugene D. Jackson, III

It is certified that error appears in the above-identified patent and that said Letters Patent are hereby corrected as shown below:

Column 1, line 17, after "necked-down" insert --nozzle--.

Column 1, line 47, after "pintle," insert --nozzle--.

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*